US007004707B2

(12) United States Patent
Suksi

(10) Patent No.: US 7,004,707 B2
(45) Date of Patent: Feb. 28, 2006

(54) MOVABLE BULK CHARGING/DISCHARGING EQUIPMENT

(75) Inventor: Jukka Suksi, Vantaa (FI)

(73) Assignee: Oy Marine Consulting Suksi Ltd., (FI)

( * ) Notice: Subject to any disclaimer, the term of this patent is extended or adjusted under 35 U.S.C. 154(b) by 0 days.

(21) Appl. No.: 10/467,072

(22) PCT Filed: Feb. 1, 2002

(86) PCT No.: PCT/FI02/00076

§ 371 (c)(1),
(2), (4) Date: Aug. 5, 2003

(87) PCT Pub. No.: WO02/062654

PCT Pub. Date: Aug. 15, 2002

(65) Prior Publication Data

US 2004/0071530 A1 Apr. 15, 2004

(30) Foreign Application Priority Data

Feb. 5, 2001 (FI) ..... 20010210

(51) Int. Cl.
*B60P 1/00* (2006.01)

(52) U.S. Cl. ..... 414/139.4; 414/347; 198/632

(58) Field of Classification Search ..... 414/139, 414/140.1, 143.2, 139.4, 141.2, 347, 400; 198/313, 581, 632
See application file for complete search history.

(56) References Cited

U.S. PATENT DOCUMENTS 1,525,950 A * 2/1925 Prescott ..... 414/140.8
3,412,876 A 11/1968 Calabrese
3,520,396 A * 7/1970 Lingg ..... 198/418.6
4,878,796 A * 11/1989 Ammeraal ..... 414/141.7
4,897,012 A 1/1990 Brewer
5,160,012 A * 11/1992 Jonke ..... 198/369.2
5,197,843 A * 3/1993 Eckel ..... 414/140.8
5,271,701 A * 12/1993 Hopland ..... 414/139.7
5,667,350 A * 9/1997 Arend et al. ..... 414/141.1

FOREIGN PATENT DOCUMENTS

WO WO 90/08690 8/1990

* cited by examiner

*Primary Examiner*—Eileen D. Lillis
*Assistant Examiner*—Charles A. Fox
(74) *Attorney, Agent, or Firm*—Connolly, Bove, Lodge & Hutz LLP

(57) ABSTRACT

The invention relates to a charging/discharging equipment movable on a quay for charging of bulk (13) into a ship's hold (11), respectively for discharging therefrom, comprising—a first conveyor for transferring a batch of bulk (13) from a quay (7) at least to the level of the board of a ship (10),—a horizontal intermediate conveyor (3) connected to the discharging end of said first conveyor to receive the batch bulk (13),—an elevator frame (4) mounted in the front of the discharging end of said intermediate conveyor (3) as well as—an elevator platform (5) movable in the elevator frame (4) between the level of the intermediate conveyor (3) and the bottom end of the elevator frame (4) for transferring the batch bulk (13) into the hold (11). The invention is characterized in that the elevator frame (4) is pivotable between a horizontal position and a vertical operating position and controllably movable between two extreme positions in its longitudinal direction in relation to the intermediate conveyor (3) and that said first conveyor and the elevator platform (5) are provided with their own conveying belts, respectively, for receiving and discharging the batch of bulk (13).

10 Claims, 5 Drawing Sheets

MOVABLE BULK CHARGING/DISCHARGING EQUIPMENT

Figure 1:
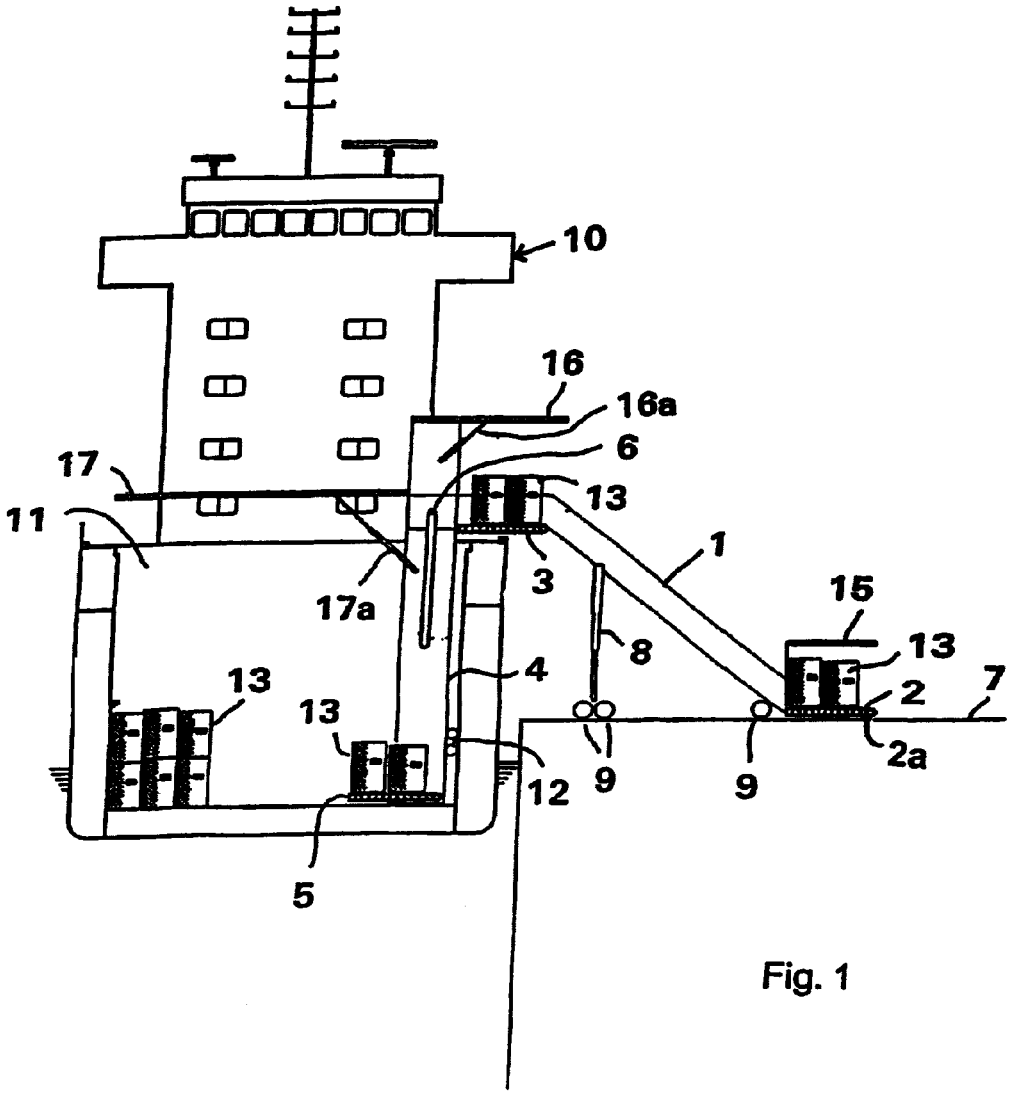

The present invention relates to charging/discharging equipment that is movable on a quay, for charging bulk into a ship's hold and discharging bulk therefrom, respectively, comprising:

- a first conveyor for transferring a batch of bulk from a quay at least to the level of the board of a ship,
- a horizontal intermediate conveyor connected to one end of said first conveyor for receiving the batch of bulk,
- an elevator frame installed in front of an end of said intermediate conveyor that is remote from said one end of said first conveyor, as well as
- an elevator platform movable along the elevator frame between a level of the intermediate conveyor and a bottom end of the elevator frame for transferring the batch of bulk into the hold.

According to the previously known technology, bulk has traditionally been charged into ships loadable from above by means of a crane either directly into the hold of the ship or if the ship is provided with a traverse crane of its own, onto a deck of the ship, wherefrom each batch of bulk has been transferred by said traverse crane to its final location in the hold. These methods are, however, relatively slow and may cause dangerous situations during the lifting stage while a heavy bulk is hanging free merely retained by a clamping means. Clamping means used today may easily damage the goods to be lifted. A further disadvantage of the above mentioned equipments is that rain sensitive goods cannot be loaded in rainy whether. Furthermore, specially equipped ships are known, having their own stationary loading systems enabling faster charging as well as charging of rain sensitive goods also when it is raining. This kind of a loading system protects goods sensitive to chargo handling. These systems usually comprise two deck elevators arranged at shipside adjacently and at a distance from each other, by means of which a batch of bulk transported to the deck of the ship, e.g. by means of a conveyor belt, is transferred down to the ship's hold. Down in the hold, the batch of bulk is then transferred, e.g. by means of a forklift truck, to a proper location. If freighting of bulk of a certain type depends merely on this kind of specially equipped ships, the availability of such ships may cause problems in freigthing at the same time as the costs of the manufacture and optionally those of the freight due to lack of suitable return cargo will be higher.

From U.S. Pat. No. 4,897,012 a loading and unloading equipment according to the introduction is known. Its carrying idea is that said equipment comprises several trucks, each of which being provided with its own drive means, which trucks are lifted by means of a first conveyor to the level of a first quide, along which the truck is moved to the discharge end of an intermediate conveyor to wait arriving of an empty elevator platform at the level of this discharging end, the truck moves then onto the elevator platform, which thereafter is lowered to the hold of the ship, where the truck is arranged to move either to a receiving or a discharging station. When another empty or loaded truck has entered the elevator platform, this will move back to the dicharging end of the intermediate conveyor, and now to a level of a second quide of the discharging end, where the truck can leave the elevator platform and move along this second quide to the inlet end of the intermediate conveyor to wait arriving of an empty elevator platform of the first conveyor. By means of this elevator platform, the truck is lowered back to the level of the quay, where it is transferred to an intermediate store to be discharged or to receive a new batch of goods. A disadvantage of this previously known equipment is that it requires a large number of transport trucks, each of which being provided with its own drive means and for which separate routes for go-and return directions are to be provided to avoid unreasonable long waiting times between the charging and discharging stages. For this reason, such an equipment must be heavily built and large-dimensioned, which leads to high manufacture and operation costs.

The object of the present invention is to overcome the afore-mentioned problems, which is achieved by a charging equipment, which is characterized in that an elevator frame is pivotable between a horizontal position and a vertical operating position and controllably movable in its longitudinal direction between two extreme positions in relation to the intermediate conveyor, and that a first conveyor and an elevator platform are provided with their own conveying belt, respectively, to receive and to deliver a batch of bulk.

In a preferred embodiment, the first conveyor comprises a transport path with an adjustable angle of inclination and a lifting platform provided with a conveyor belt or a similar device and movable along said transport path.

For the purpose of charging, the charging equipment according to the invention is positioned on the quay alongside a ship to be charged in such a way that the horizontal intermediate conveyor will extend beyond the board of the ship to the space above a charging opening, the elevator frame is pivoted to its vertical position and is lowered to the bottom of the hold of the ship, whereafter the charging can be started. Due to this charging equipment, bulk of a desired type can easily be charged into any freighter loadable from above so that no specially equipped ships are needed. Therefore, it is possible for each cargo to use the nearest available freighter, which by means of the charging equipment according to the invention is loadable as quickly and without any damage to chargo as a ship provided with its own loading systems.

The heigth of the intermediate conveyor is preferably adjustable by means of a lifting support mounted under the transport path. By adjusting the length of the lifting support, the conveyor can continuously be kept on a desired level above the board of the ship in spite of the fact that the ship will be pressed deeper and deeper during charging.

In order to facilitate the transferability of the charging equipment in the port area, it is preferably provided with wheels or tracks by which it can easily be transferred from one object to another. Preferably, at least a part of the wheels is pivotable, and at least one wheel, or a pair of wheels, may be connected to a drive means, so that the equipment can be transferred from one place to another by its own driving force. Naturally, an external force can also be used for transportation of the equipment. During the transportation of the charging equipment from one object to another, the elevator frame is always kept in its horizontal position, whereby the hight of the equipment is lowest.

A batch of bulk to be charged is transported e.g. by a forklift truck, or a similar transport equipment, to the first conveyor, in an advantageous embodiment to a lifting platform. Thereby motion of the lifting platform along the transport path up to the receiving end of the horizontal intermediate conveyor is started. When the lifting platform has arrived at this end station, the belt conveyor of the lifting platform and the intermediate conveyor are set into action, whereby the batch of bulk resting upon the lifting platform is transferred onto the intermediate conveyor. When the batch of bulk is on the intermediate conveyor, both conveyors are stopped and a return motion of the lifting platform down to its receiving position is started.

The elevator platform is provided with its own conveyor belt to enable receipt of the batch of bulk resting upon the intermediate conveyor. When the elevator platform has risen to the level of the intermediate conveyor, both the intermediate conveyor and the belt conveyor of the elevator platform are set into action, whereby the batch of bulk resting upon the intermediate conveyor is transferred further onto the elevator platform. When the batch of bulk is transferred onto the elevator platform, both conveyors are stopped and the elevator platform is set in motion along the elevator frame down to the hold, where there is a forklift truck, or a similar transport equipment, by which the batch of bulk at the elevator platform is transferred to a desired location in the hold. After the elevator platform has been unloaded, it is moved along the elevator frame back to the level of the intermediate conveyor to receive a new batch of bulk.

Preferably, on that side of the elevator frame which in its operating position is facing the wall of the hold, means are mounted to maintain the relative position between the ship and the elevator frame during charging. By means of this it is ensured that the elevator platform in its receiving position always will take a horizontal position in which the intermediate conveyor is which will avoid any damage of an edge of even sensitive goods during their transfer from the intermediate conveyor onto the elevator platform.

In order to protect the batches of bulk against rain, the lifting platform can be provided with a lightweight structural cover which moves together with the lifting platform along the transport path. Alternatively, the whole transport path can be covered. At the upper end of the elevator frame, a further, foldable, lightweight structural cover can be mounted to protect a batch of bulk resting upon the intermediate conveyor. Preferably, on the opposite side of the elevator frame, a further larger-sized, foldable, lightweight structural cover may be arranged to cover the open part of the hold.

Preferably, in order to ensure a passageway between the hold and the quay dining the charging, a ladder way/running platform is arranged along one side of the elevator frame, the intermediate conveyor and the fist conveyor.

Figure 2:
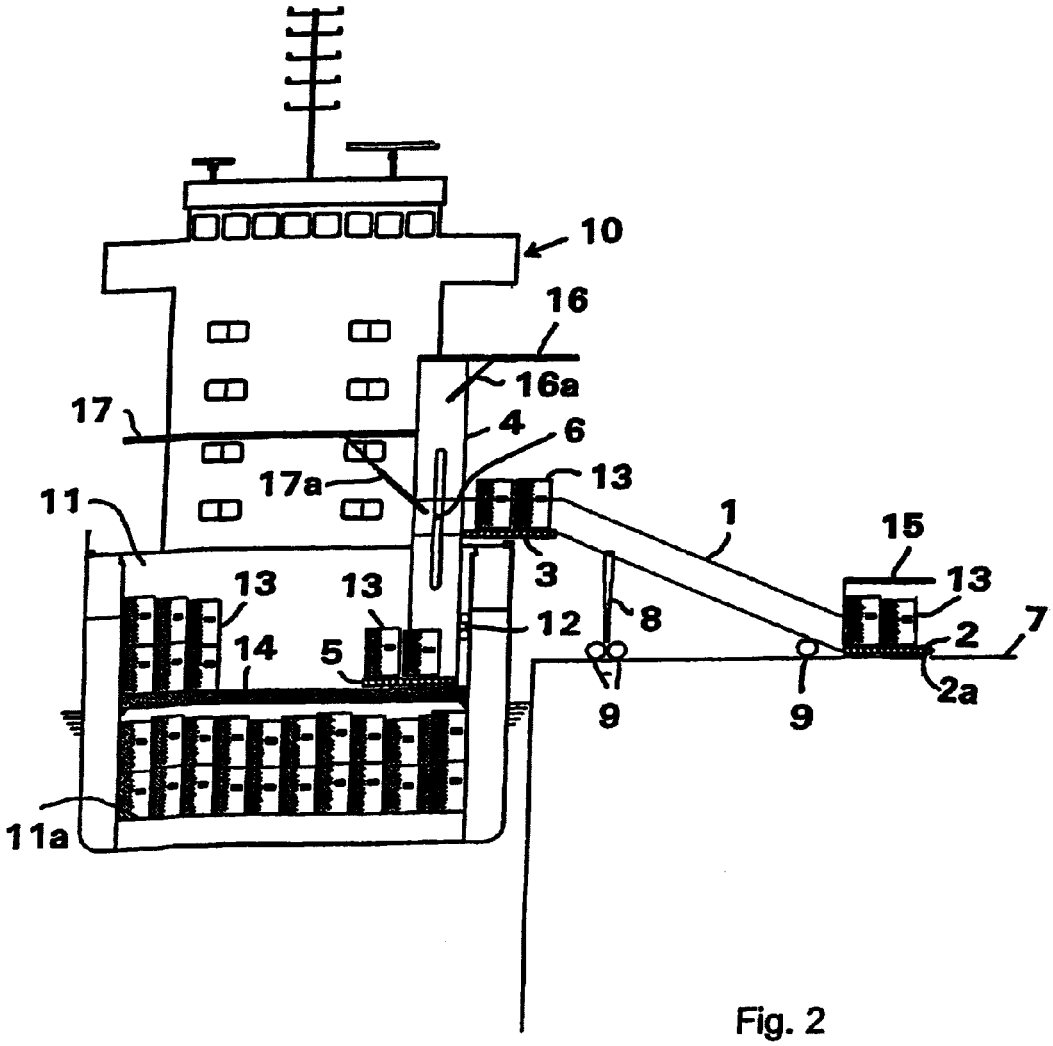
Figure 3:
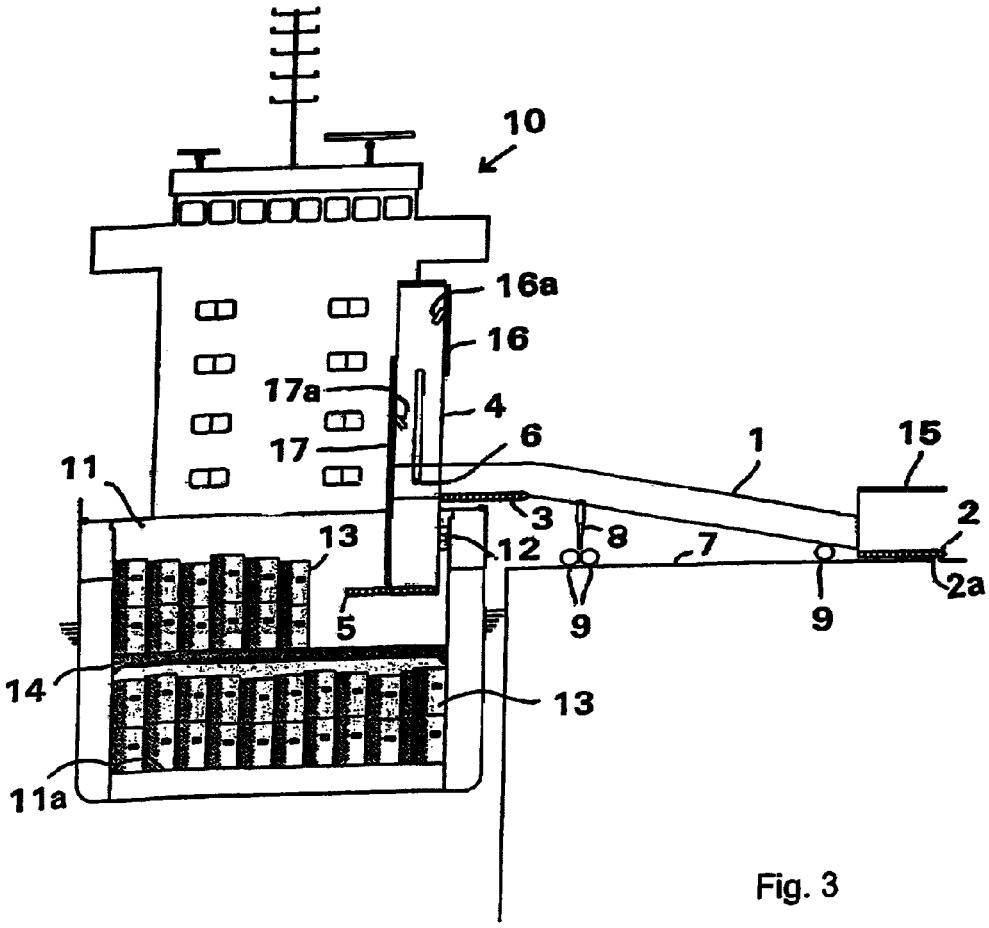
Figure 4:
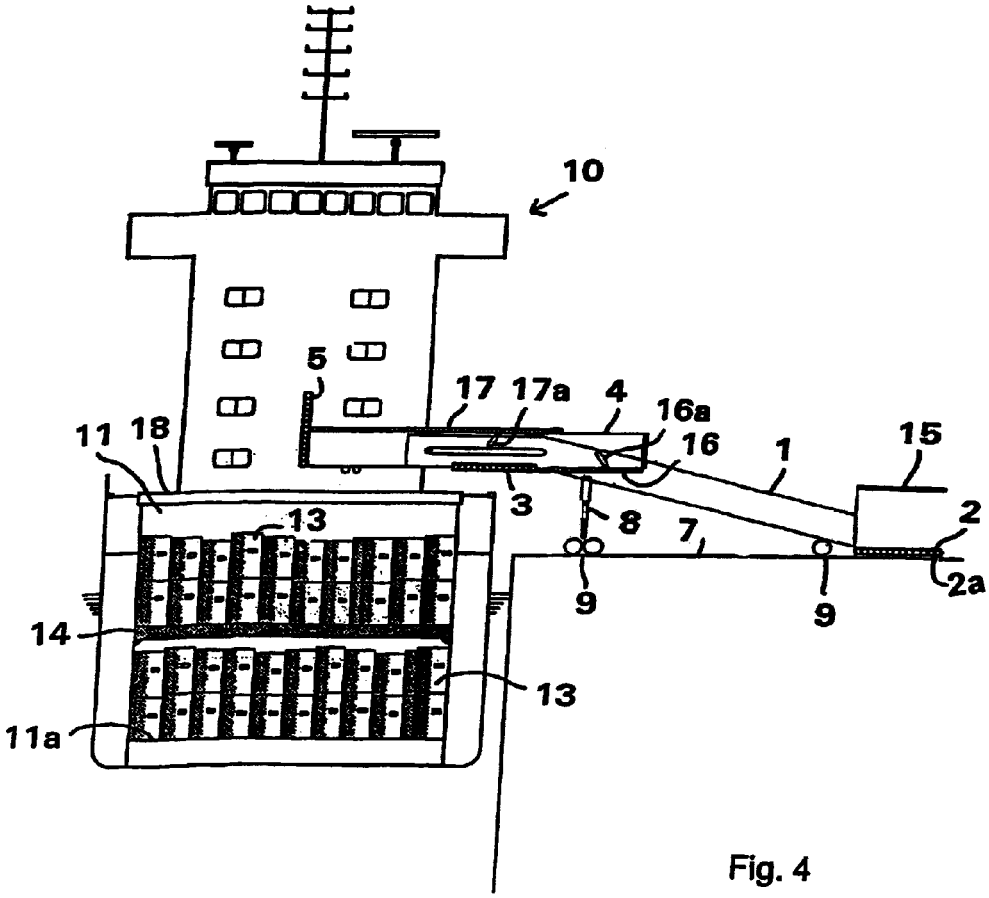
Figure 5:
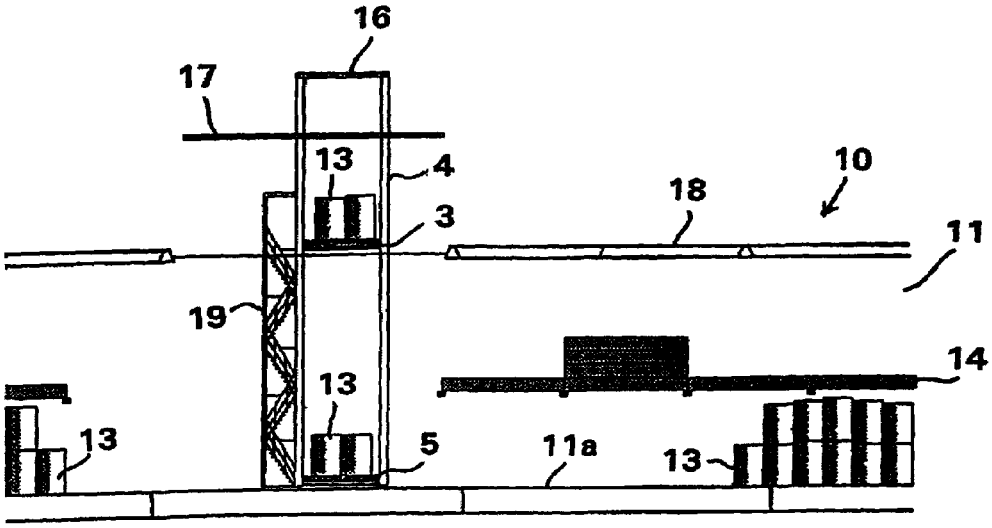

In the following the invention is described in more detail with reference to the drawings in which FIG. 1 shows an example of a charging equipment according to the invention in its operating position in an initial stage of charging, viewed in the longitudinal direction of the ship to be charged;

FIG. 2 shows the charging equipment of FIG. 1 in its operating position in a situation when the tank top is filled and charging onto a middle deck is going on;

FIG. 3 shows a situation when charging of said middle deck is completed, and as a first measure, the elevator frame has been lifted to its highest position for removing the charging equipment, FIG. 4 shows a situation when the elevator frame has been turned to its horizontal position whereby the charging equipment is ready to be removed from the shipside, and FIG. 5 shows a situation equivalent to that of FIG. 1, viewed in the cross direction of the ship.

The charging equipment shown in the drawings comprises a transport path 1, the angle of inclination of which being adjustable, and a lifting platform 2 movable along said transport path and provided with a conveying belt 2*a*, a horizontal intermediate conveyor 3 connected to the discharging end of the transport path 1 as well as an elevator frame 4 mounted in front of said discharging end, along which an elevator platform 5 provided with a conveying belt is arranged to move. The elevator frame 4 is pivotable around a horizontal axis 6 between a horizontal position (FIG. 5) and a vertical operating position as well as controllably movable between two extreme positions in its longitudinal direction in relation to the intermediate conveyor 3 (FIG. 1 and FIG. 3, respectively), while in its vertical operating position. The height of the intermediate conveyor in relation to the ground, i.e., to the level of the quay 7 is adjustable by means of a lifting support 8 installed under the transport path 1. In the illustrated embodiment the lifting support 8 is telescopic, but other embodiments are possible, as well. To facilitate the transferability of the charge equipment, this has been provided with wheels 9, e.g. as shown in the drawings, whereby one pair of wheels 9 has been arranged at the entering end of the transport path 1 and a boggie provided with four, or optionally eight wheels 9, is arranged under the lifting support 8 or lifting supports. The wheels 9 at the entering end can be turnable and some of the wheels 9 under the lifting support 8 can be driving wheels.

The charging equipment operates as follows:

When a ship 10 is to be charged, the charging equipment is moved on a guay to shipside while the elevator frame 4 is in its horizontal position. The discharging end of the transport path 1, at which the intermediate conveyor 3 and the elevator frame 4 are mounted, is then lifted by means of the lifting support 8, until the intermediate conveyor 3 is at a higher level than the board of the ship 10 facing the quay. The charging equipment is then moved closer to the ship 10 so that the intermediate conveyor 3 extends beyond the board of the ship above its open hold 11. The elevator frame 4 is then pivoted to its vertical position and moved down until its bottom end comes into contact with the bottom of the hold 11 or to the lowest position of the elevator frame 4, while the intermediate conveyor 3 is in contact with a carvel work of the hold, the charging equipment being in its operating position. In order to keep the elevator frame 4 in a proper position during the charging so that the elevator platform 5 and the intermediate conveyor 4 are positioned at the same horizontal level to avoid damages of edges of bulk while the elevator platform 5 is in its receiving position, means 12 to keep the distance between the elevator frame 4 and the wall of the hold 11 essentially constant are mounted on the side of the elevator frame 4 facing the wall of the hold.

When the charging begins, the lifting platform 2 is located in its receiving position shown in FIG. 1, and a first batch of bulk is loaded thereon by means of a forklift truck, or a similar transport equipment, which batch in the case shown in the drawings consists of four paper rolls 13. The lifting platform 2 is then immediately set in motion along the transport path 1 to level of the intermediate conveyor 3, where it is stopped, and the belt conveyor 2*a* of the lifting platform 2 and the intermediate conveyor 3 are then set into action so that said paper rolls 13 are transferred onto the intermediate conveyor 3. Then both conveyors 2, 3 are stopped, and the lifting platform 2 is set in return motion along the transport path 1 to its receiving station to receive a new batch of paper rolls 13. The elevator platform 5 is lifted along the elevator frame 4 until it reaches the level of the intermediate conveyor, where it is stopped. Then the intermediate conveyor 3 and the conveying belt of the elevator platform 5 are set into action, until the batch of paper rolls 13 has been transferred onto the elevator platform 5, whereby said conveyors 3, 5 are stopped, and the elevator platform 5 is set in motion along the elevator frame 4 down to the bottom of the hold 11 where there is preferably a forklift truck or a similar transport equipment to transfer the paper rolls 13 to a place reserved for them in the hold 11. As The ship 10 is pressed deeper into water during the charging, the intermediate conveyor 3 and the elevator frame 4 are lowered further down by adjusting the length of the lifting support 8, as can be seen when the FIGS. 1 and 3 are compared with each other.

When a tank top 11*a* of the ship 10 has been filled, the elevator frame 4 is lifted upwards so far that the parts of a middle deck 14 can be installed, whereafter the elevator frame 4 is lowered into contact with the middle deck 14, or to a predetermined intermediate level, while the intermediate conveyor 3 being supported by the carvel work of the ship's hold, and the charging is continued on in the above described manner. The situation shown in FIG. 2 illustrates the charging onto the middle deck 14.

In order to avoid weather dependency of the charging, the lifting platform 2 may be provided with a lightweight structural cover 15 moving together with the lifting platform 2 while this moves along the transport path 1. The batch of paper rolls 13 resting upon the intermediate conveyor 3 may preferably be protected by a lightweight structural cover 16 arranged at the upper end of the elevator frame 4, which in the embodiments shown in the drawings can be lifted by means of a cylinder-piston-device 16*a*, or a mechanical device, to an operating position and be let down to a rest position when charging is completed. On the opposite side of the elevator frame 4, a similar, but a larger-sized, lightweight structural cover 17 can be mounted, which, after having been raised to its operating position by means of a cylinder-piston-device 17*a* or a mechanical device, is adapted to cover The open part of the hold 11.

When the charging of the middle deck 14 has been completed, the elevator frame 4 is lifted to its highest position and the covers 16 and 17 are let down to a rest position against the sides of the elevator frame 4, which situation is illustrated in FIG. 3. Subsequently, the elevator frame 4 is pivoted to the horizontal position as shown in FIG. 4, whereafter the charging equipment can be removed from the shipside to the next object. The hatches 18 of the weather deck of the ship are then put in their places. In order to enable a free passageway between the quay 7 and the hold 11 during the charging stage, a ladder way/passage platform 19 may be provided along one side of the elevator frame 4, and at a side of the intermediate conveyor 3 and the first conveyor which ladder way is shown in FIG. 5

The various operations of the charging equipment can be driven electrically and/or hydraulically, or by means of another driving force.

In the foregoing it has merely been described how the charging/discharging equipment operates during charging of bulk into a ship, but it is obvious that the equipment can as well be applied to discharging of bulk from the ship, in which case the operations are carried out in a reverse sequence.

What is claimed is:

1. Charging and discharging equipment movable on a quay, for charging of bulk into a ship's hold and for discharging of bulk from the ship's hold, said equipment comprising:

a first conveyor for transferring a batch of bulk from a quay at least to a level of a board of a ship, a horizontal intermediate conveyor connected to one end of said first conveyor to receive the batch of bulk, an elevator frame mounted in front of an end of said intermediate conveyor that is remote from said one end of said first conveyor, and an elevator platform movable in the elevator frame between a level of the intermediate conveyor and a bottom end of the elevator frame for transferring the batch of bulk to the hold, wherein the elevator frame is pivotable between a horizontal position and a vertical operating position and is controllably movable in a longitudinal direction between two extreme positions in relation to the intermediate conveyor and wherein the first conveyor and the elevator platform are provided with their own conveying belts, respectively, for receiving and discharging the batch of bulk.

2. The charging and discharging equipment according to claim 1, wherein the first conveyor comprises;

a transport path having an adjustable angle of inclination; and a lifting platform movable along said transport path and provided with a conveying belt.

3. The charging and discharging equipment according to claim 2, wherein a height of the intermediate conveyor is adjustable by means of a lifting support mounted under the transport path.

4. The charging and discharging equipment according to claim 1, wherein a the charging and discharging apparatus is provided with wheels or tracks to facilitate transferability of the charging and discharging equipment in a harbor area.

5. The charging and discharging equipment according to claim 2, wherein, when the lilting platform, which has received a batch of bulk, has reached an upper end of the transportation path, the conveying belt of the lifting platform and the horizontal intermediate conveyor can be set into action to transfer said batch of bulk from the lifting platform onto the intermediate conveyor.

6. The charging and discharging equipment according to claim 5, wherein, when the elevator platform has reached the level of the intermediate conveyor, the intermediate conveyor and the conveying belt of the elevator platform can be set into action to transfer the batch of bulk on the intermediate conveyor to the elevator platform.

7. The charging and discharging equipment according to claim 1, wherein means for maintaining a relative position between the ship and the elevator frame during the charging are mounted at a side of the elevator frame facing a wall of the hold in its working position.

8. The charging and discharging equipment according to claim 1, wherein the lifting platform is provided with a lightweight structural cover.

9. The charging and discharging equipment according to claim 7, wherein a foldable, lightweight structural cover extending above the intermediate conveyor and a larger-sized, foldable, lightweight structural cover extending across an open part of the hold are mounted at an upper end of the elevator frame.

10. The charging and discharging equipment according to claim 1, wherein a ladder way or running platform is arranged along one side of the elevator frame, at a side of the intermediate conveyor and the first conveyor to provide a passageway between the quay and the hold.

* * * * *